US007113059B2

(12) United States Patent
Asamura

(10) Patent No.: US 7,113,059 B2
(45) Date of Patent: Sep. 26, 2006

(54) VARIABLE-FREQUENCY HIGH FREQUENCY FILTER

(75) Inventor: Fumio Asamura, Saitama (JP)

(73) Assignee: Nihon Dempa Kogyo Co., Ltd., Tokyo (JP)

( * ) Notice: Subject to any disclaimer, the term of this patent is extended or adjusted under 35 U.S.C. 154(b) by 66 days.

(21) Appl. No.: 11/046,155

(22) Filed: Jan. 28, 2005

(65) Prior Publication Data

US 2005/0162241 A1 Jul. 28, 2005

(30) Foreign Application Priority Data

Jan. 28, 2004 (JP) ..... 2004-020503
Nov. 15, 2004 (JP) ..... 2004-330532

(51) Int. Cl.
*H01P 1/203* (2006.01)

(52) U.S. Cl. ..... 333/205; 333/235

(58) Field of Classification Search ..... 333/205, 333/204, 235
See application file for complete search history.

(56) References Cited

U.S. PATENT DOCUMENTS 6,606,017 B1 * 8/2003 Xu et al. ..... 333/205
6,798,319 B1 9/2004 Aikawa et al.
6,909,333 B1 * 6/2005 Aikawa et al. ..... 331/56

FOREIGN PATENT DOCUMENTS

JP 2003-115701 4/2003

* cited by examiner

*Primary Examiner*—Stephen E. Jones
(74) *Attorney, Agent, or Firm*—Knobbe Martens Olson & Bear, LLP

(57) ABSTRACT

A frequency-variable high frequency filter comprises: a substrate; a ground conductor having an opening provided on one principal surface of the substrate; a center conductor provided in the opening to make up a coplanar line resonator with the substrate and the ground conductor; an input line and an output line provided on the other principal surface of the substrate and electromagnetically coupled with the center conductor; and a variable reactance element. The center conductor is divided into two conductor section at the position of the null point of the voltage displacement of a standing wave created in the coplanar line resonator so that the two conductor sections are separated in the longitudinal direction of the center conductor. The variable reactance element is inserted in the center conductor to connect the two conductor sections of the center conductor.

11 Claims, 6 Drawing Sheets

VARIABLE-FREQUENCY HIGH FREQUENCY FILTER

BACKGROUND OF THE INVENTION

1. Field of the Invention

The present invention relates to a high frequency filter employed in the ultra high frequency band (approximately 1 to 100 GHz) covering the frequency range such as microwave and millimeter-wave bands, and particularly to an easily designable, variable-frequency high frequency filter adapted to use a coplanar line resonator and capable of electronically controlling the filter characteristics such as a transmission characteristic, particularly a band characteristic or the like.

2. Description of the Related Arts

A high frequency filter has been widely employed as a functional element imperative for injection and extraction of a desired signal and also suppression and elimination of unwanted signals in transmission and reception apparatuses, in a variety of radio communication facilities, optical fiber high-speed transmission apparatuses and measuring instruments related to the above apparatuses.

Conventionally, the high frequency filters for the microwave and higher-frequency bands have been realized typically through the use of metal waveguides and dielectric resonators. The high frequency filters of a microwave integrated circuit configuration as well have been used in recent years for the purpose of promoting the scaling down of circuitry. The present inventors have proposed in Japanese Patent Laid-open Publication No. 2003-115701 (JP, P2003-115701A) a high frequency filter using a coplanar line resonator, having a microwave integrated circuit configuration and capable of electronically controlling the filter characteristics.

FIG. 1A is a schematic plan view illustrating a conventional high frequency filter using a coplanar line resonator and capable of electronically controlling the filter characteristics. FIG. 1B is a cross-sectional view along line A—A of FIG. 1A.

This high frequency filter is made up through the use of a coplanar line, which is a transmission line of a coplanar configuration, as a resonator. A coplanar configuration refers to a high frequency transmission line made up of a metal conductor formed on one principal surface of a substrate. Hence, a transmission line made of a microstrip line is not included in a transmission line of a coplanar configuration, because a microstrip line needs, in addition of a signal line provided on the one principal surface of the substrate, a ground conductor provided on the other principal surface of the substrate.

Ground conductor 2 is provided on one principal surface of substrate 1 made of dielectric material and a rectangular opening 3 is formed in ground conductor 2. In opening 3, center conductor 4, which functions as a signal line, is provided extending in the longitudinal direction of opening 3. The coplanar line resonator is configured by ground conductor 2 provided on the one principal surface of substrate 1 and center conductor (i.e., signal line) 4 arranged inside opening 3 formed in ground conductor 2, as described above. Here, the resonator is constructed such that the length of center conductor 4 is approximately $\lambda/2$, wherein it is assumed that the wavelength corresponding to the intended resonance frequency f0 is $\lambda$. Both ends of center conductor 4 are spaced apart from ground conductor 2 at both ends (the left and right ends in the figure) of opening 3 thereby forming electrically open ends. This arrangement allows generation of a standing wave having a null point (i.e., node) of a voltage displacement at the middle point that longitudinally bisects center conductor 4 and maximum (peak) voltage displacements of mutually reverse polarities at both longitudinal ends of center conductor 4 as depicted as curve S illustrated in FIG. 1B, yielding a capability of acting as a resonator. It should be noted that the coplanar line is an unbalanced transmission line that allows traveling of a high frequency electromagnetic wave caused by an electric field, generated between center conductor 4 and ground conductor 2, and a magnetic field induced by the electric field.

Furthermore, in the one principal surface of substrate 1, variable capacitance diodes 5 are arranged individually allocated to both end portions of opening 3, i.e., the gaps between both ends of center conductor 4 and ground conductor 2. In the illustrated example, using solder for example, variable capacitance diodes 5 connect respective ends of center conductor 4 and the edge portions of ground conductor 2 across the end portions of opening 3 with the anodes connected to center conductor 4. To the middle point of the coplanar line resonator, i.e., the middle point that longitudinally bisects center conductor 4, is connected one end of one of supply lines 6*a* for applying control voltage Vc to variable capacitance diodes 5. The other supply line 6*b*, i.e., one end of the ground line, is connected to ground conductor 2. The above arrangement allows applying control voltage Vc, which is a reverse voltage (a negative voltage), to the anode of each variable capacitance diode 5 and varying the capacitance values of the diodes.

Input line 7 and output line 8 are provided on the other principal surface of substrate 1 in the respective areas corresponding to both end portions of center conductor 4. Input line 7 is made up of a closed loop section, which surrounds the left end portion, as viewed in the figure, of center conductor 4 and an extension section that extends from the closed loop section to the left end portion, as viewed in the figure, of substrate 1. The closed loop section of input line 7 is provided to traverse center conductor 4 under the neighborhood of the left end, as viewed in the figure, of center conductor 4 and further surround variable capacitance diode 5. Similarly, output line 8 is made up of a closed loop section, which surrounds the right end portion, as viewed in the figure, of center conductor 4 and an extension section that extends from the closed loop section to the right end portion, as viewed in the figure, of substrate 1. The closed loop section of output line 8 is provided to traverse center conductor 4 under the neighborhood of the right end, as viewed in the figure, of center conductor 4 and further surround variable capacitance diode 5. These input line 7 and output line 8 form microstrip line structures together with ground conductor 2 and are electrically connected with the coplanar line, which acts as a resonator, through electromagnetic coupling. The position that input line 7 or output line 8 traverses center conductor 4 is referred to as a transverse point. In this example, the distance between the transverse point of input line 7 and the left end of center conductor 4 is taken to be equal to the distance between the transverse point of output line 8 and the right end of center conductor 4. This distance is denoted as d.

This structure of the resonator allows generating a plurality of resonance points operable as an input/output resonance point in the high frequency filter depending on a boundary condition stipulated on the basis of the positions of input line 7 and output line 8 provided on the other principal surface of the substrate and traversing the coplanar line resonator, for example, the lengths from the transverse points of input line 7 and output line 8 to the ends of center conductor 4. In the above example, because length d between the transverse point and the end of center conductor 4 is the same for input line 7 and for output line 8, basically one input/output resonance point is generated at the frequency corresponding to a wavelength wherein one fourth the wavelength equals d. Specifically, because the length from the transverse point to the tip of the center conductor is one-fourth the wavelength, both ends of the center conductor behave as electrically short-circuit ends as viewed from respective transverse points. Consequently, a high frequency current is created having one-fourth the wavelength equal to that length, yielding an input/output resonance point that causes a voltage fall in the frequency region on the high-frequency side of the resonance characteristic of center conductor 4. Because center conductor 4 functions as a both-end open half-wavelength resonator, and because the distances from respective transverse points to the corresponding ends of center conductor 4 are necessarily shorter than half the length of center conductor 4 itself, the resonance frequency at the input/output resonance point is necessarily higher than the resonance frequency of the coplanar line resonator.

As shown in FIG. 2, in this high frequency filter, attenuation pole P due to the input/output resonance point is created in the frequency region on the high-frequency side of the band characteristic curve (curve T) for the high frequency filter provided with the coplanar line resonator. Consequently, the characteristic curve exhibits a steep gradient of attenuation on the high frequency side of the resonance frequency of the coplanar line resonator f0, as shown by curve U. As a result, the band characteristic of the high frequency filter comes to have a substantially narrowed-down bandwidth, entailing enhancement of an apparent Q value. In the above example, the distances d between both ends of center conductor 4 and the respective transverse points of input line 7 and output line 8 are equal to each other. As a result, the two input/output resonance points are substantially degenerated to one resonance point causing the attenuation level at the attenuation pole P to increase by just that much.

Further, connecting variable capacitance diodes 5 between both ends of the coplanar line resonator, i.e., both ends of center conductor 4, and ground conductor 2 allows variation of resonance frequency f0 to be caused through the variation of the capacitance by means of control voltage Vc. In this arrangement, because variable capacitance diodes 5 are arranged in the electric fields generated between center conductor 4 and ground conductor 2, the capacitance variation of variable capacitance diodes 5 yields equivalently the variation of an electrical length of center conductor 4. In this way, a so-called voltage-controlled high frequency filter is constituted.

In the foregoing high frequency filter, employing a coplanar line resonator of a coplanar structure enables both terminals of variable capacitance diodes 5 to be connected on the same plane to apply the surface mount technology to the mounting of variable capacitance diodes 5. In addition, connecting the supply lines 6*a* to the middle point that bisects center conductor 4, i.e., connecting the supply lines 6*a* to the middle point of a half-wavelength resonator, which is a null point (a minimum point) of the voltage displacement, and applying control voltage Vc to the middle point substantially minimizes the influence of the providing of the supply line on the resonance characteristic.

The high frequency filter using the coplanar line resonator of the above structure, however, is configured such that, while both ends of center conductor 4 are spaced apart from ground conductor 2 at both ends of opening 3 electrically to make open ends, variable capacitance diodes 5 are arranged there. Variable capacitance diode 5 varies the value of its capacitance through the application of control voltage Vc from supply lines 6 provided in the middle point of center conductor 4. In this arrangement, for example, if the value of the capacitance of variable capacitance diodes 5 is large, then a high frequency current corresponding to the capacitance of variable capacitance diodes 5 is generated at both ends of center conductor 4 causing the characteristics of the resonator to vary in the direction from an ideal electrical open end to a short-circuit end. As a result, a variation of control voltage Vc causes changes in positions of the maximum voltage displacements at both end portions of center conductor 4 and further causes the null point of the voltage displacement, which should be in the middle point of center conductor 4, to displace making the null point deviate from the middle point. Consequently, the position of one of the supply lines 6*a* provided at the middle point of center conductor 4 deviates from the null point of the voltage displacement, i.e., the position of the supply line 6*a* comes to the position where a voltage displacement is present due to the voltage standing wave. As a result, connection of supply line 6*a* affects the resonance characteristics of the resonator, which makes it difficult to design the resonator. For example, when the capacitance of variable capacitance diodes 5, to which reference control voltage Vco is applied, is taken as a reference capacitance and the central resonance frequency of the resonator for the reference capacitance is denoted as f0, it becomes difficult to grasp the variation of resonance frequency when a control voltage differing by some value from reference control voltage Vco is applied. In addition, the deviation of the position of the null point from the middle point of the resonator brings about difficulty in the foregoing control of the frequency of the input/output resonance point, further entailing difficulty in designing a filter having desired attenuation characteristics.

The arrangement of connecting capacitances created by the variable capacitance diodes with both ends of center conductor 4 acts to lower the maximum voltage value (the magnitude of the voltage displacement) in the point of the maximum voltage displacement of the standing wave induced in center conductor 4. Furthermore, in the case where the capacitance variation characteristics of the pair of variable capacitance diodes 5 against control voltage Vc are different, the balance with respect to the middle point of center conductor 4 is lost, entailing a loss. Due to the above facts, the Q value, which indicates resonance sharpness, lowers and the resonance characteristic of the resonator is degraded.

SUMMARY OF THE INVENTION

It is an object of the present invention to provide a frequency-variable high frequency filter configured to have a position of the voltage-displacement null point in a coplanar line resonator fixed to facilitate designing the filter and also configured to obviate lowering the Q value to improve the resonance characteristics.

The object of the present invention can be attained by the high frequency filter comprising: a substrate; a ground conductor having an opening provided on one principal surface of the substrate; a center conductor provided on the one principal surface of the substrate in the opening and making up a coplanar line resonator of a coplanar structure together with the substrate and the ground conductor; an input line and an output line provided on the other principal surface of the substrate and adapted to electromagnetically couple with the center conductor; and a variable reactance element inserted in the center conductor at the position of the null point of the voltage displacement of a standing wave created in the center conductor operating as a resonator, wherein the center conductor is divided into a first conductor section and a second conductor section at the inserted position of the variable reactance element so as to separate the first and second conductor sections in the longitudinal direction of the center conductor, the variable reactance element being connected at one end to the first conductor section and at the other end to the second conductor section.

According to the present invention, it is enabled to make the resonance frequency of the filter variable through the use of the control voltage applied to a voltage-controlled variable reactance element, because the center conductor of the coplanar line resonator is divided at the null point of the voltage displacement, for example, at the middle point in the longitudinal direction of the center conductor, where the variable reactance element is connected. The influence of the provision of the variable reactance element and the circuitry to apply a control voltage to the variable reactance element on the resonance characteristic can be prevented, because the element and circuitry are arranged in the neighborhood of the null point of the voltage displacement in the standing wave. Nor, the control voltage causes the position of the null point in the voltage displacement to be displaced. For these reason, the present invention enables easily grasping the relation between the magnitudes of the variations in the control voltage and the resonance frequency and facilitating the designing of the filter and also enables realizing a low loss and high Q-value filter having a superior resonance characteristic.

Furthermore, providing at least one of the input and output lines so as to traverse the center conductor yields an input/output resonance point at a frequency point higher than the resonance frequency of the coplanar line resonator to comply with the boundary condition, which enables establishing an attenuation pole on the high frequency side of the resonance frequency, thereby boosting the attenuation gradient on the high frequency side. Further, establishing the input/output resonance point makes it possible to realize a desired filter characteristic.

DETAILED EXPLANATION OF PREFERRED EMBODIMENT

Figure 1A:
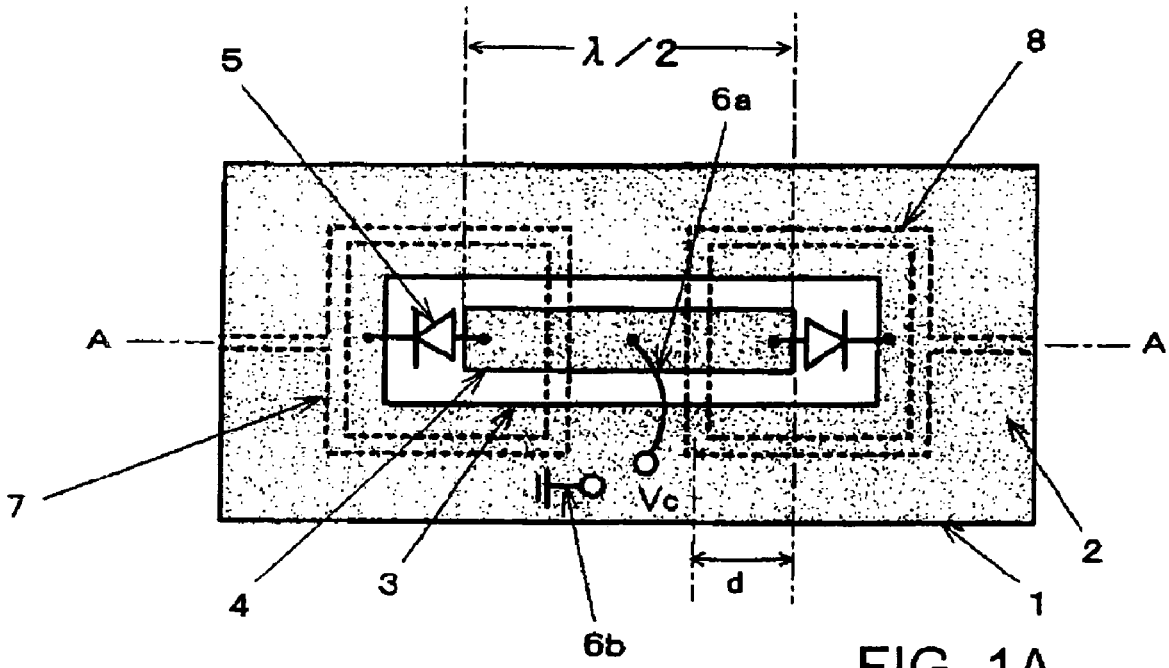
FIG. 1A (BACKGROUND ART)
FIG. 1A is a plan view illustrating a conventional frequency-variable high frequency filter.
Figure 1B:
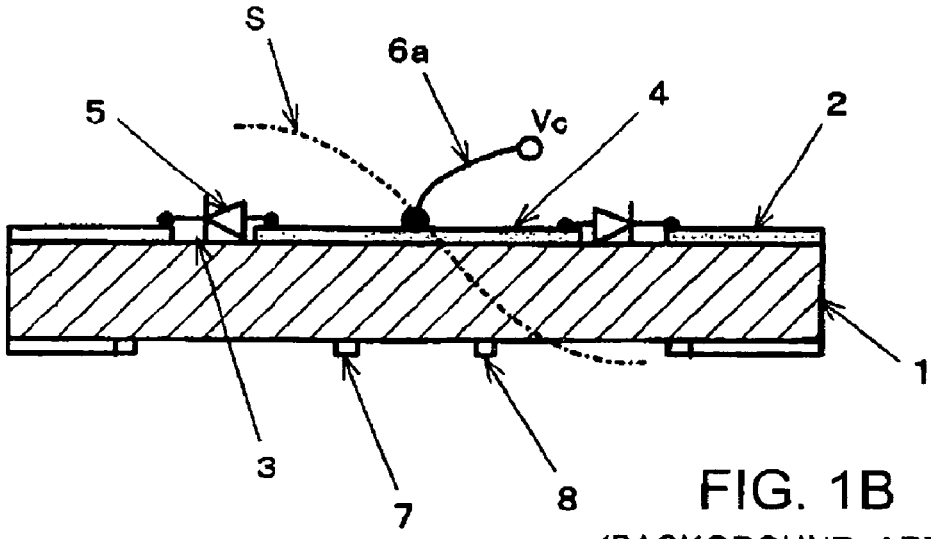
FIG. 1B (BACKGROUND ART)
FIG. 1B is a cross-sectional view taken along line A—A of FIG. 1A.
Figure 2:
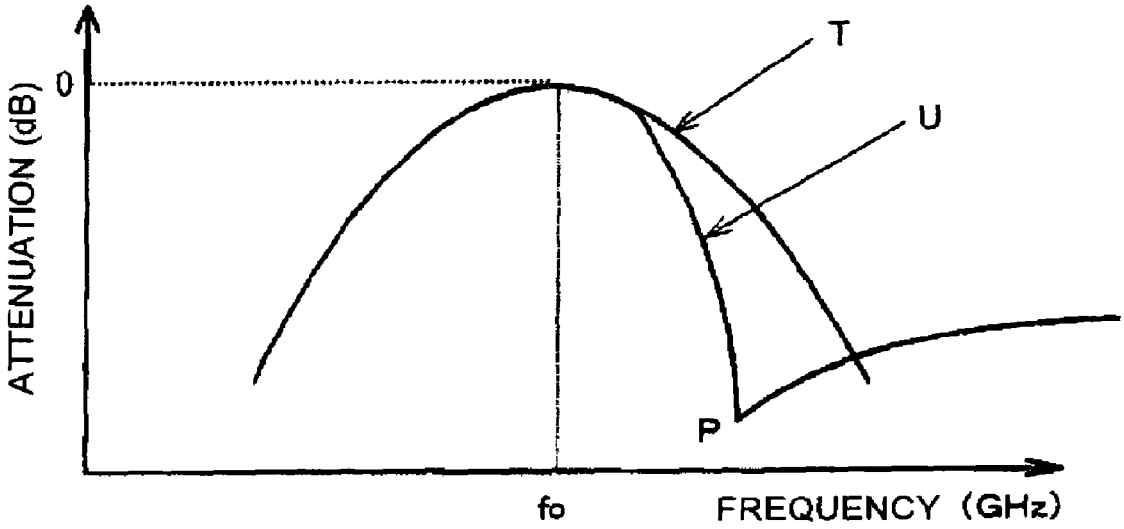
FIG. 2 (BACKGROUND ART)
FIG. 2 is a graph illustrating the transmission characteristic (i.e., filter characteristic) of the high frequency filter shown in FIGS. 1A and 1B.
Figure 3A:
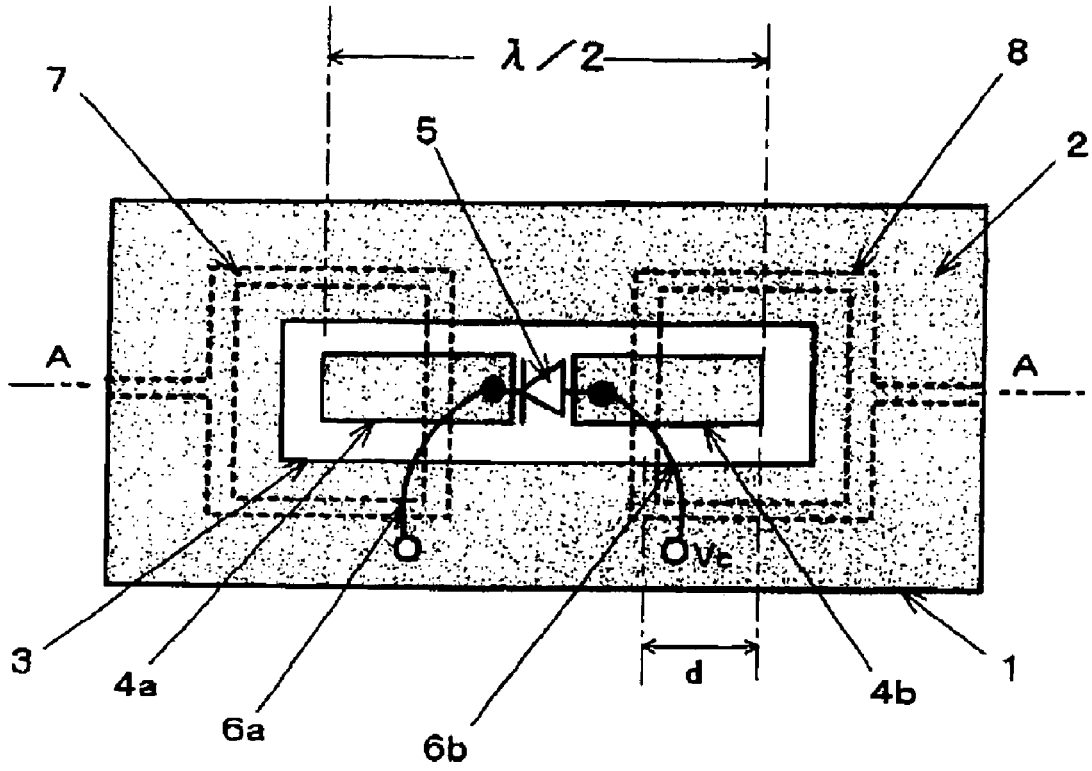
FIG. 3A is a plan view illustrating the high frequency filter according to the first embodiment of the present invention.
Figure 3B:
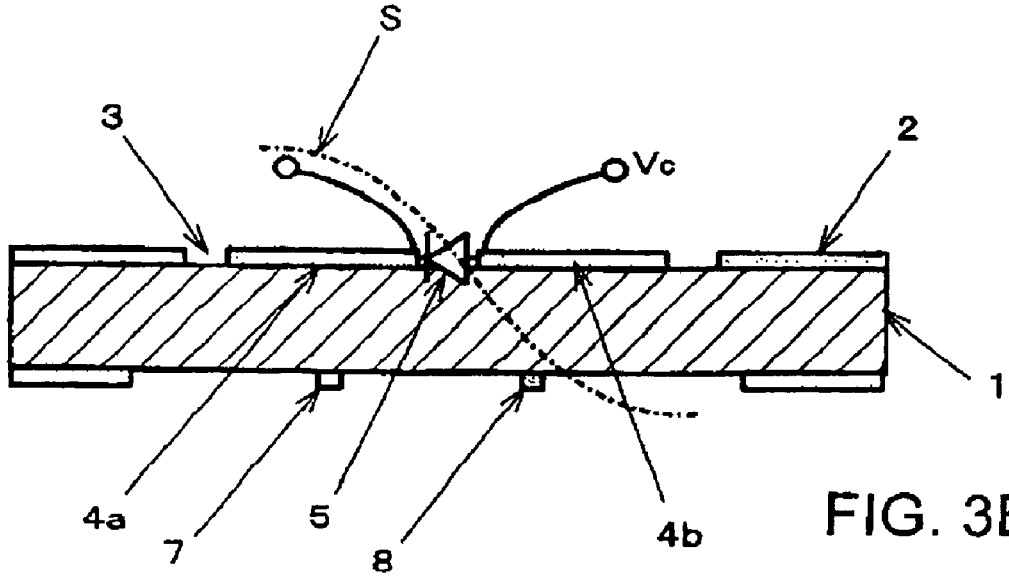
FIG. 3B is a cross-sectional view taken along line A—A of FIG. 3A.

In FIGS. 3A and 3B that illustrate a high frequency filter of a first embodiment according to the present invention, the constituent elements that are identical to the constituent elements in FIGS. 1A and 1B bear the same reference numerals, and repeated explanation of such elements is simplified.

The high frequency filter illustrated in FIGS. 3A and 3B is a voltage-controlled high frequency filter of a frequency variable type, provided with a coplanar line resonator of a coplanar structure. Specifically, ground conductor 2 is provided on one of the principal surfaces of substrate 1 made of dielectric material, and rectangular opening 3 is formed in ground conductor 2. Center conductor 4 that extends in the longitudinal direction of opening 3 is provided in opening 3. Both ends of center conductor 4 are spaced apart from ground conductor 2. As with the case of a conventional high frequency filter shown in FIGS. 1A and 1B, input line 7 and output line 8 are provided on the other principal surface of substrate 1, and each of input line 7 and output line 8 has a closed loop section that traverses center conductor 4. Each of input line 7 and output line 8 makes a microstrip line structure making use of ground conductor 2, and is formed in the range from the middle point to the corresponding end of center conductor 4. In the present embodiment, the distance d from the transverse point to an end of center conductor 4 is the same for input line 7 and for output line 8, wherein the transverse point refers to the position where each of input line 7 and output line 8 traverses center conductor 4. Center conductor 4 is $\lambda/2$ long. wherein $\lambda$ stands for the wavelength corresponding to resonance frequency f0 of the filter.

In the present embodiment, center conductor 4 is divided, at the position of the longitudinally middle point of center conductor 4, into two sections, which are arranged spaced apart from each other. The sections of the divided center conductor 4 are hereinafter referred to as conductor sections 4*a* and 4*b*, respectively. Variable capacitance diode 5 is arranged in the gap between conductor sections 4*a* and 4*b* with the anode and cathode connected with the opposed ends of conductor sections 4*a* and 4*b* across the gap. Further, variable capacitance diode 5 is connected with a pair of supply lines 6*a*, 6*b* and control voltage Vc is applied such that the cathode of variable capacitance diode 5 takes the ground potential and the anode has a reverse voltage (i.e., negative voltage).

This structure yields an input/output resonance point in compliance with the boundary condition stipulated on the basis of the positions of input line 7 and output line 8 traversing the coplanar line resonator, as with the conventional high frequency filter shown in FIGS. 1A and 1B, entailing creation of an attenuation pole P on the high frequency side in the band characteristic curve of the resonator. Because the distances from the transverse points to the corresponding ends of center conductor 4 are the same for input line 7 and output line 8, the same boundary condition holds for both of input line 7 and output line 8. This causes degeneration of the input/output resonance points leading to creation of a single attenuation pole of a high attenuation level. Consequently, the attenuation gradient becomes steep in the region of frequencies higher than the resonance frequency f0, resulting in the reduction of the passband width and increase in an apparent Q value.

In this high frequency filter, because variable capacitance diode 5 is connected between conductor sections 4*a* and 4*b* that make up the coplanar line resonator, the capacitance variation of variable capacitance diode 5 generated by applied control voltage Vc equivalently causes an overall electrical length of center conductor 4 to be varied, thereby changing the resonance frequency of the filter.

In this arrangement, both ends of center conductor 4 function as electrical open ends that are completely open-circuited from ground conductor. 2. Accordingly, even when control voltage Vc is applied to variable capacitance diode 5 to control the resonance frequency, the line impedance substantially keeps infinity at each of both ends of center conductor 4, and both ends of center conductor 4, which is a half wavelength resonator, become the maximum voltage displacement points having mutually opposite phases of the standing wave. The middle point of center conductor 4, i.e., the position where conductor sections 4*a* and 4*b* face each other across a gap, acts as a null point of the voltage displacement regardless of control voltage Vc.

For this reason, although the anode and cathode of variable capacitance diode 5 are connected to the opposing ends of conductor sections 4*a* and 4*b* and supply lines 6*a* and 6*b* are connected to these ends, in the neighborhood of the middle point of center conductor 4, it is possible to suppress the influence of providing the diode and supply lines on the resonance characteristics and on the standing wave in the resonator, because the positions where the diode and supply lines are connected are in the region of the null point of the voltage displacement regardless of control voltage Vc. As a result, it becomes feasible to grasp a theoretical variation of the resonance frequency against control voltage Vc, thereby enabling the designing of a high frequency filter to be facilitated. In other words, it is facilitated to grasp the deviation of the resonance frequency from f0 against control voltage Vc, wherein f0 stands for the central resonance frequency when the reference control voltage Vco is applied to variable capacitance diode 5. While not shown, a choke coil or the like for blocking high frequency components can be inserted as required in supply lines 6*a* and 6*b*.

The arrangement of both ends of center conductor 4 spaced apart from ground conductor 2 to construct electric open ends allows the maximum voltage displacement points at both ends of center conductor 4 to preserve the maximum voltages without any decrease. The standing wave on both sides of the middle point of the resonator preserves a symmetric property, because, in principle, a single variable capacitance diode is inserted in the middle point of center conductor 4. For these reasons, the high frequency filter of the present embodiment enables suppressing a loss and boosting the Q value, thereby improving the resonance characteristics.

Figure 4:
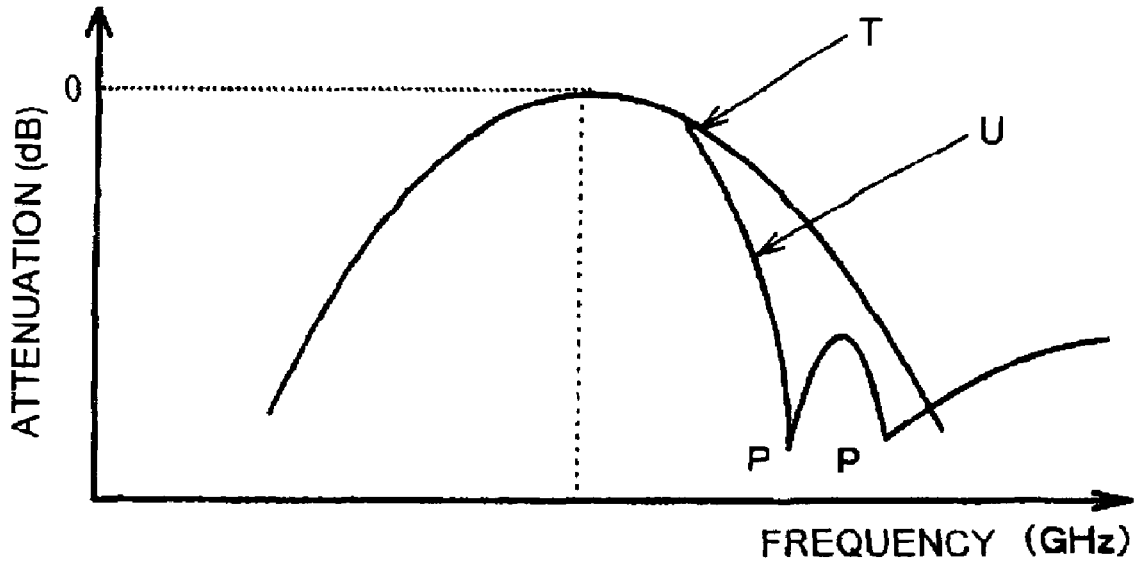
FIG. 4 is a graph illustrating the transmission characteristic (i.e., filter characteristic) of the high frequency filter based on the first embodiment.

In the above high frequency filter, while it is presumed that the distances between the transverse points and the corresponding ends of the center conductor for input line 7 and output line 8 equal each other and equal d, it is feasible to make the distance for input line 7 different from that for output line 8. Such an arrangement, however, generates two input/output resonance points in principle, because different boundary conditions are applied to input line 7 and output line 8. Consequently, two attenuation poles Ps are created associated with the transmission characteristic exclusively of a half-wavelength resonator (figured curve T) outside the band of the transmission characteristic as shown in FIG. 4, resulting in creation of a transmission characteristic of a great attenuation amount in a wide frequency region (figured curve U).

It is possible to create resonance points at which attenuation levels differ depending on a boundary condition other than the distance between each of input line 7 and output line 8 and the corresponding end of center conductor 4. The number and positions of these additional input/output resonance points can be determined depending on the specifications of the high frequency filter, i.e., the required transmission characteristics and selected as required.

Figure 5A:
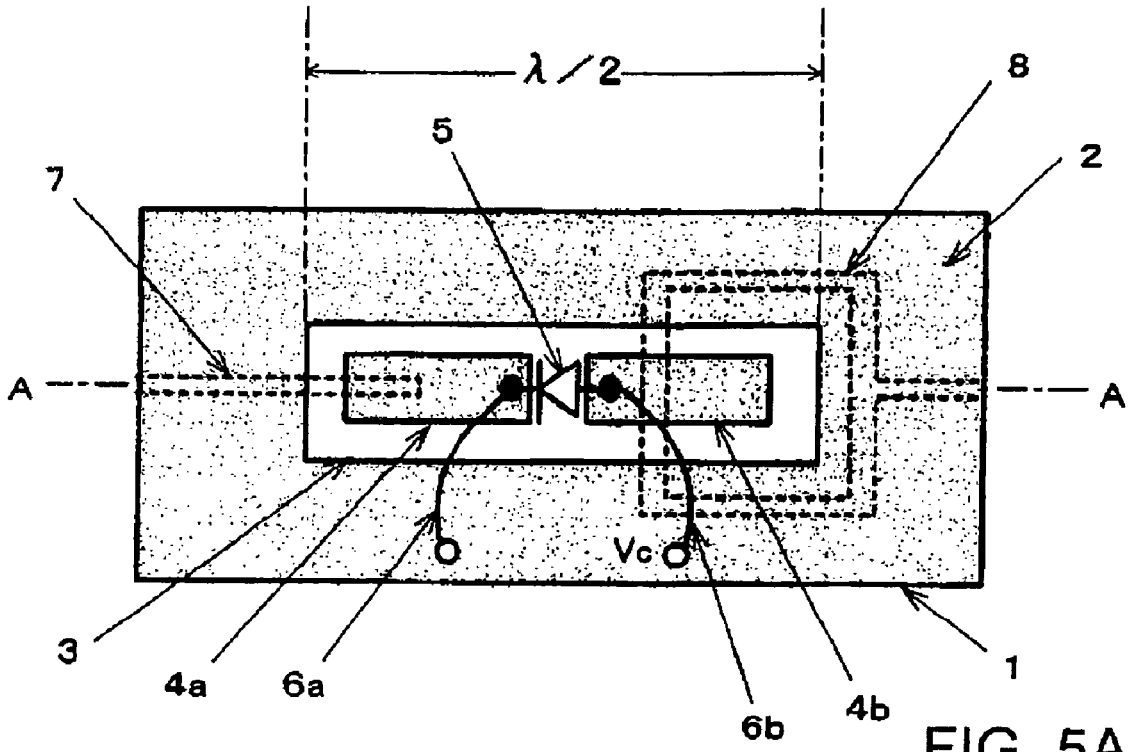
FIG. 5A is a plan view illustrating the high frequency filter according to the second embodiment of the present invention.
Figure 5B:
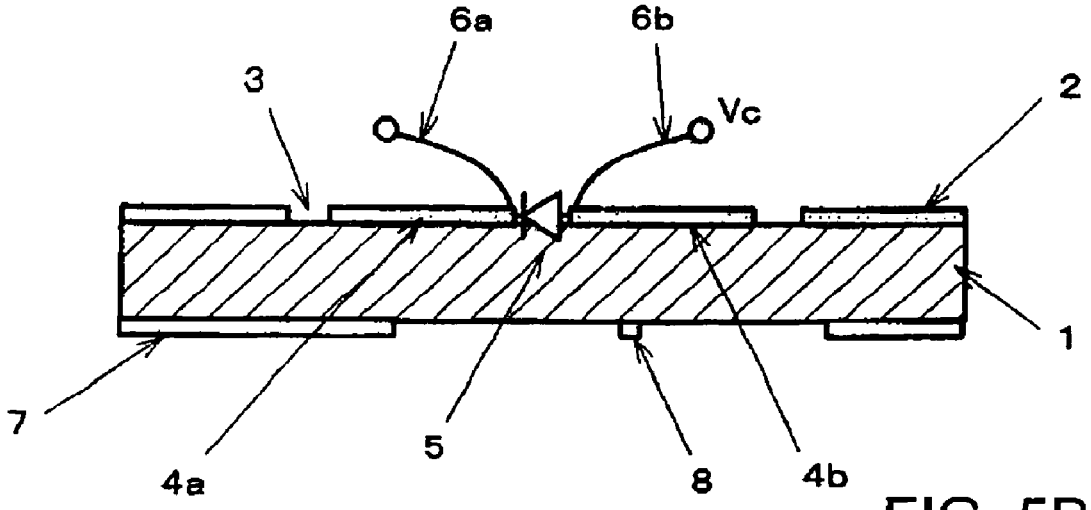
FIG. 5B is a cross-sectional view taken along line A—A of FIG. 5A.

Explanation is next presented for the high frequency fitter according to a second embodiment of the present invention. The high frequency filter of the second embodiment illustrated in FIGS. 5A and 5B is configured such that a change is made in the structure of the input line in the high frequency filter of the first embodiment shown in FIGS. 3A and 3B. Specifically, while in the high frequency filter of the first embodiment, both of input line 7 and output line 8 have closed loop sections each of which traverses center conductor 4, input line 7 of the high frequency filter of the second embodiment has no closed loop section. Output line 8 has a closed loop section.

More specifically, in the high frequency filter of the second embodiment, center conductor 4 has conductor sections 4*a* and 4*b* made by dividing center conductor 4 at the longitudinally middle point of center conductor 4 with variable capacitance diode 5 arranged between and connected across conductor sections 4*a* and 4*b*, just like the high frequency filter of the first embodiment. In addition, a pair of supply lines 6*a* and 6*b* are provided to apply control voltage Vc.

Input line 7, which is provided on the other principal surface of substrate 1 and functions as a microstrip line, linearly extends from the left side in the figure along the extending direction of center conductor 4 with the tip position reaching the middle area of conductor section 4*a*. Accordingly, input line 7 is formed in an overlapped fashion with center conductor 4 at the neighborhood of its tip position along the same direction as center conductor 4, thereby electrically connected with conductor section 4*a* basically through the capacity coupling. Output line 8 has a closed loop section and traverses conductor section 4*b*, as with the first embodiment.

This arrangement creates input/output resonance point at a resonance frequency higher than that of the coplanar line resonator depending on the boundary condition based on the position of output line 8 as described in the first embodiment. This input/output resonance point creates attenuation pole P on the high frequency side of the band characteristic of the filter having a steep attenuation gradient. Input line 7, in contrast, creates no input/output resonance point attributed to the boundary condition, because input line 7 does not traverse but only overlaps with one of the divided conductors 4*a* in the same direction. In this filter, since it suffices for the input/output resonance point basically to take only one resonance point caused by output line 8 into account, the number of the input/output resonance points is fewer than that in the first embodiment, which facilitates designing.

In this high frequency filter, since basically a single variable capacitance diode 5 is inserted in the middle point of center conductor 4 of the coplanar line resonator as with the first embodiment, the neighborhood of the middle point of center conductor 4 becomes a null area of the voltage displacement regardless of control voltage Vc applied to the diode. As a result, it is enabled to reduce an influence of providing a diode and supply lines on the resonance characteristics and thereby to facilitate designing of the filter. In addition, the values of the maximum voltage at the maximum voltage displacement points disposed at both ends of center conductor 4 are preserved and also the symmetry of the standing wave is ensured, whereby a loss is reduced, the Q-value is enhanced and the satisfactory resonance characteristics are obtained.

The foregoing explanation regards the high frequency filters according to the present invention. The high frequency filter of the present invention is not necessarily limited to the above filters.

Figure 6A:
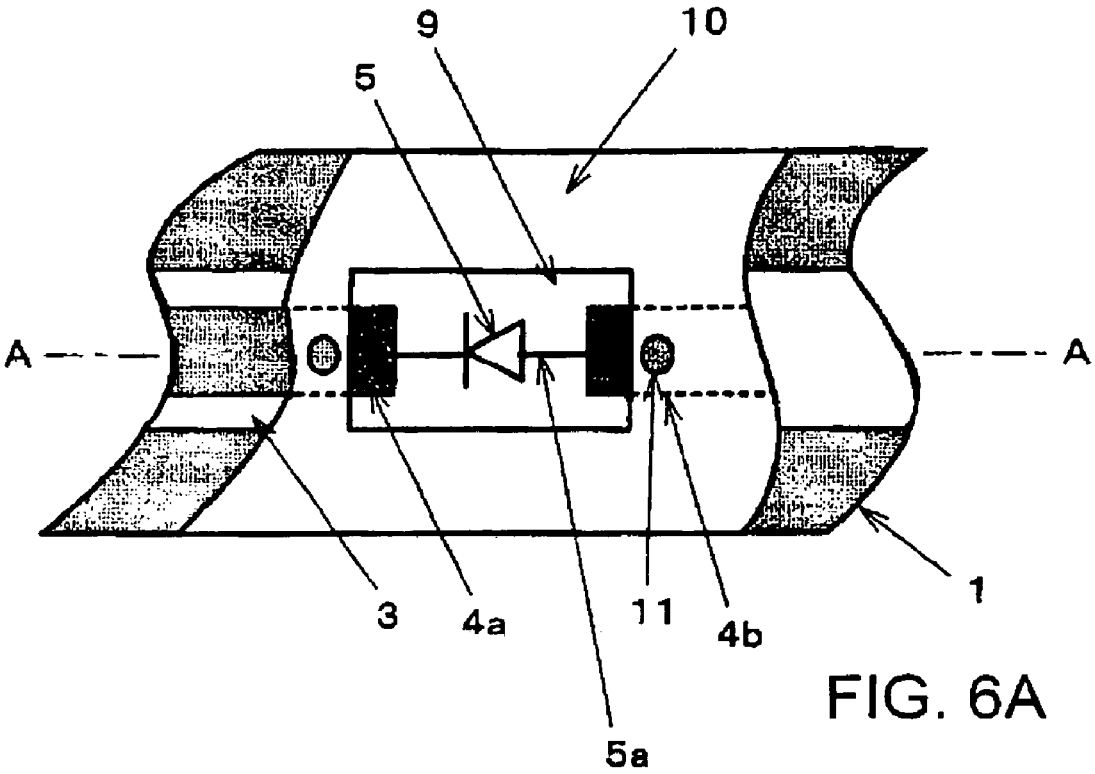
FIG. 6A is a plan view illustrating the high frequency filter according to an alternative embodiment of the present invention.
Figure 6B:
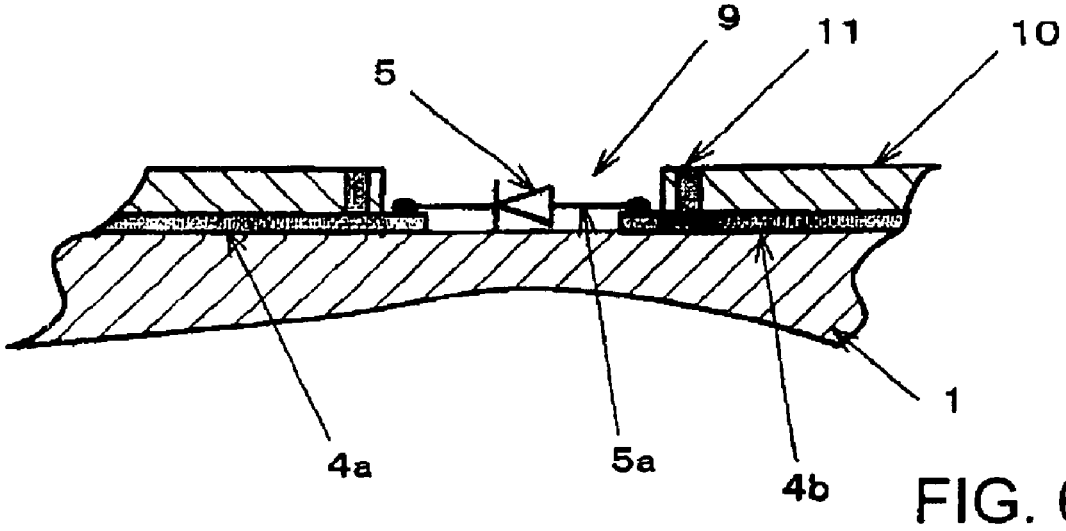
FIG. 6B is a cross-sectional view taken along line A—A of FIG. 6A.

FIGS. 6A and 6B represents a high frequency filter provided with an additional dielectric substrate 10 on the one principal surface of dielectric substrate 1, on which the coplanar line resonator is formed, so as to cover the coplanar line resonator. The substrate 10 has through-hole 9 formed in a dimension so as to allow receiving variable capacitance diode 5. The substrate 10 is arranged on substrate 1 so that variable capacitance diode 5 may be exposed in this through-hole 9. In this arrangement, control voltage Vc can be applied to the anode and cathode of variable capacitance diode 5 through via-holes 11 provided in substrate 10.

This arrangement makes it enabled to form a conductor pattern (not shown) connected to the via-holes 11 on substrate 10, extend it to the end portion of substrate 10 and connect the conductor pattern directly to the connectors of a cable for feeding. Furthermore, in this case, it is possible to make the high frequency filter have further multiple functions by arranging, for example, alternative circuit elements on the surface of substrate 10.

It is also possible to constitute the high frequency filters of the foregoing present embodiments in a cascaded structure or multistage structure. In this case, a plurality of coplanar line resonators are formed along the longitudinal direction of the given reference resonator on one principal surface of the same dielectric substrate and coupling lines having closed loops in both ends are provided on the other principal surface of the dielectric substrate. Each of the coupling lines acts, at one of the looped ends, as an output line of the preceding coplanar line resonator and at the same time, acts, at the other looped end, as an input line of the subsequent coplanar line resonator. The preceding and subsequent coplanar line resonators are electromagnetically interconnected through the coupling line. By cascade-connecting a plurality of coplanar line resonators in this way, a cascaded variable frequency high frequency filter can be realized. In this case also, due to the coupling line connecting respective coplanar resonators, each of the coplanar line resonators creates input/output resonance points at the frequencies higher than the resonance frequency of the resonator itself. As a result, attenuation poles P are created on the high frequency side of the band characteristic of each coplanar line resonator, causing the attenuation gradient on the high frequency side of the band characteristic curve to be steepened. If the central resonance frequencies of the plurality of the coplanar line resonators are made coincident with one another, then a sharp band characteristic can be obtained as a whole, and if the central resonance frequencies of the plurality of the coplanar line resonators are staggered, then a wide-band filter characteristic can be obtained.

In the above high frequency filter, while the length of the center conductor is designed to be half a wavelength corresponding to the resonance frequency, the length can equal one wavelength. Generally speaking, an integer multiple of a half-wavelength suffices for the length of the center conductor 4 so that the voltage distribution of the standing wave will be asymmetric with respect to the middle point of center conductor 4. While in these cases, the occasions can take place in which the geometrical middle point of center conductor 4 viewed in the longitudinal direction is not the null point of the voltage displacement, it is preferred in such occasions to divide center conductor 4 at the null point of the voltage displacement of the standing wave induced in center conductor 4 and insert a variable reactance element at the divided position.

It is feasible as substrate 1 to use, alternatively of the substrate made of simply dielectric material, a substrate made of magnetic material or a substrate of semiconductor material.

Although the above embodiment employs a variable capacitance diode as a variable reactance element, the present invention does not limit the variable reactance element to the variable capacitance diode. In the present invention, any variable reactance element can be employed if the reactance of the element can be varied by an applied voltage. For example, it is feasible to use an element having an inductance variable depending on a control voltage.

According to the present invention, because the coplanar line resonator that makes up a filter has a coplanar structure, not only a variable reactance element of a surface mount structure but a beam lead semiconductor element and a flip-chip IC through the bump mounting or the like can also be mounted on the filter with a high accuracy and efficiently. The surface mount structure referred herein refers to the structure that can be arranged on the same plane and includes the structures having a mounting terminal for mounting directly on the container body of the element and also having a lead wire.

What is claimed is:

1. A high frequency filter comprising:

a substrate, a ground conductor having an opening provided on one principal surface of said substrate, a center conductor provided on said one principal surface of said substrate in said opening and making up a coplanar line resonator of a coplanar structure together with said substrate and said ground conductor, an input line and an output line provided on the other principal surface of said substrate and adapted to electromagnetically couple with said center conductor, and a variable reactance element inserted in said center conductor at the position of a null point in voltage displacement of a standing wave created in the center conductor operating as a resonator, wherein said center conductor is divided into a first conductor section and a second conductor section at the inserted position of said variable reactance element so as to separate the first and second conductor sections in a longitudinal direction of said center conductor, said variable reactance element being connected at one end to said first conductor section and at the other end to said second conductor section.

2. The filter according to claim 1, wherein at least one of said input line and said output line has a portion that traverses said center conductor.

3. The filter according to claim 1, wherein one of said input line and said output line has a portion that traverses said center conductor and the other of said input line and said output line has a portion overlapping said center conductor along a direction in which said center conductor extends.

4. The filter according to claim 1, wherein said center conductor has a length of half a wavelength corresponding to a resonance frequency, a longitudinal middle point of said center conductor being the position of the null point of the voltage displacement.

5. The filter according to claim 1, wherein said substrate is a dielectric substrate.

6. The filter according to claim 1, further comprising a second substrate arranged so as to cover said coplanar line resonator.

7. The filter according to claim 1, further comprising means for applying a control voltage to said variable reactance element.

8. The filter according to claim 7, wherein said variable reactance element comprises a variable capacitance diode.

9. The filter according to claim 1, wherein both of said input line and said output line have respective portions that traverse said center conductor.

10. The filter according to claim 9, wherein distance from a position where said input line traverses said center conductor to one end of said center conductor equals distance from a position where said output line traverses said center conductor to the other end of said center conductor.

11. The filter according to claim 9, wherein distance from a position where said input line traverses said center conductor to one end of said center conductor differs from distance from a position where said output line traverses said center conductor to the other end of said center conductor.

* * * * *